US005653166A

United States Patent [19]

Mohammed et al.

[11] Patent Number: 5,653,166

[45] Date of Patent: Aug. 5, 1997

[54] METHOD FOR MOLDING A DESIGN IN LOW RELIEF IN AN INK PRINTED ON FABRIC

[75] Inventors: Sultan Mohammed, Stone Mountain; Peter D. Beaumont, Atlanta; Geoffrey H. Efaw, Norcross; Kohler F. Steven, Stone Mountain, all of Ga.

[73] Assignee: Winning Image, Inc., Atlanta, Ga.

[21] Appl. No.: 219,669

[22] Filed: Mar. 29, 1994

(Under 37 CFR 1.47)

[51] Int. Cl.[6] ..... B31F 1/07; B44C 1/24

[52] U.S. Cl. ..... 101/32; 101/491; 101/115; 101/128.21; 101/129; 156/277; 428/138; 264/52; 264/DIG. 82

[58] Field of Search ..... 101/32, 27, 491, 101/9, 114, 115, 126, 128.21, 129; 428/137, 138, 195, 196, 289, 290; 156/384, 63, 78, 79, 219; 264/132, 134, 135, 136, 137, DIG. 82, 52

[56] References Cited

U.S. PATENT DOCUMENTS

| | | | |
|---|---|---|---|
| 2,705,682 | 4/1955 | Wille . | |
| 3,301,174 | 1/1967 | Sciame | 101/27 |
| 3,399,106 | 8/1968 | Palmer et al. | 264/DIG. 82 |
| 3,660,187 | 5/1972 | Shortway et al. | 156/79 |
| 3,808,024 | 4/1974 | Witman | 156/78 |
| 3,861,955 | 1/1975 | Lemelson | 101/129 |
| 3,966,532 | 6/1976 | Harasta | 156/344 |
| 4,004,503 | 1/1977 | Dwyer | 101/27 |
| 4,012,248 | 3/1977 | Rump et al. | 156/79 |
| 4,022,643 | 5/1977 | Clark | 156/384 |
| 4,154,882 | 5/1979 | Ungar et al. | 264/132 |
| 4,187,338 | 2/1980 | Miura | 428/159 |
| 4,217,385 | 8/1980 | Shortway et al. | 264/DIG. 82 |
| 4,273,819 | 6/1981 | Schmidle et al. | 156/219 |
| 4,302,489 | 11/1981 | Hattori et al. | 264/DIG. 82 |
| 4,303,695 | 12/1981 | McCann et al. | 156/79 |
| 4,314,767 | 2/1982 | Bussard | 156/251 |
| 4,409,275 | 10/1983 | Samowich | 428/138 |
| 4,421,561 | 12/1983 | Brixius | 106/27 |
| 4,740,258 | 4/1988 | Breitscheidel | 156/209 |
| 4,838,965 | 6/1989 | Bussard | 156/277 |
| 4,844,849 | 7/1989 | Miller et al. | 264/DIG. 82 |
| 4,845,778 | 7/1989 | Peterson | 2/24 |
| 4,933,991 | 6/1990 | Love | 2/115 |
| 5,169,435 | 12/1992 | Sherman et al. | 264/52 |
| 5,281,499 | 1/1994 | Bussard | 156/267 |
| 5,300,173 | 4/1994 | Lin et al. | 101/115 |
| 5,407,729 | 4/1995 | Verden et al. | 428/196 |
| 5,431,501 | 7/1995 | Hale et al. | 400/120.02 |
| 5,455,129 | 10/1995 | Bussard | 430/1 |

FOREIGN PATENT DOCUMENTS 26 50 216 5/1977 Germany .

*Primary Examiner*—Eugene H. Eickholt
*Attorney, Agent, or Firm*—Deveau, Colton & Marquis

[57] ABSTRACT

A method of molding a design in low relief in an area of printing ink with a puffing agent placed on fabric which comprises applying a molding die with a reverse impression of the design to be molded on the ink under heat and pressure for a sufficient time to activate the puffing agent to produce a molded design in the ink with a minimum change to the physical configuration of the underlying fabric. Heat and pressure can also be applied through a transfer medium to the area surrounding where the design in low relief is to be formed to enhance the feel or hand of the fabric. This method is especially useful for molding a design on cotton and cotton blend T-shirts and sweatshirts, hats and denim jackets.

19 Claims, 2 Drawing Sheets

METHOD FOR MOLDING A DESIGN IN LOW RELIEF IN AN INK PRINTED ON FABRIC

BACKGROUND OF THE INVENTION

1. Field of the Invention

The present invention relates to a method of molding a design in low relief into a printing ink containing a puffing agent which has been placed on the fabric. A molding die with a reverse impression of the design to be molded into the ink under heat and pressure is applied to ink with the puffing agent to produce the molded design into the ink.

2. Background of Embellishing Fabrics With Designs

A number of different methods have been used to embellish fabrics with designs, particularly clothing made from cotton such as T-shirts and sweatshirts. Multi-color designs have been printed on T-shirts and sweatshirts by screen printing for some time. These designs have made these articles of clothing very popular. The designs can be printed with a single color or with several colors. Designs with logos and natural scenes have been especially popular. Screen printing suffers from the disadvantage that the amount of ink required on dark garments makes the design rough to the touch on the front of the garment. This roughness can also be frequently felt on the back of the garment as well, which is particularly objectionable if the garment is worn next to the skin. Consumers like to have a garment that has a soft feel or hand on both the front and the back. Attempting to impart a soft feel or hand to a garment has placed a severe limitation upon the type of designs that can be screen printed on garments that have been dyed a dark color.

There has been an interest for some time in making designs in relief (i.e., three dimensional) on garments. One approach that has been used is to emboss a design into a garment. In embossing, a backing is first placed on the back of the fabric in the area that is to be embossed. This backing is usually made of an adhesive coated fabric. A die with the desired design in relief is pressed down on the fabric under heat to stretch the fabric into proper position which the backing helps hold in proper place. Embossing is a slow process as the die must be pressed on the fabric for a relatively long time before the design becomes set. While embossing can be used to produce an attractive design, it suffers from several disadvantages. The projections on the embossing die actually stretch the fabric and backing into relief. This stretched fabric and the backing can result in irritation to the skin of the person wearing the fabric made into a garment. The front of the garment that is embossed does not have a very soft hand either. This means that the fabric does not feel soft as the hand is being lightly rubbed over it. The types of designs that can be embossed are limited in that resistance of the fabric, and especially the backing material, does not permit embossing designs that have sharp corners and angles. Thus, embossing is limited to designs with gentle and rounded curves. Emboss backing materials can cause problems in the washing and care of the garment.

Embossing can be coupled with screen printing to produce an attractive design, but the combination suffers from a number of disadvantages. The embossing itself results in the garment not having a soft hand. The amount of ink used in screen printing can also result in the garment not having a soft hand as it builds up on the surface. While the combination may produce an attractive design, it does not meet the demands of consumers in that the garment is not comfortable to wear because it does not have a soft hand.

The combination of screen printing and embossing is a time consuming process. The embossing itself requires a considerable amount of time to stretch the fabric and lock it into the desired relief position resulting in low productivity.

Another disadvantage of embossing is that the recessed areas cannot be easily printed with ink. It is a very time consuming and expensive process. If the ink is printed on prior to embossing, it tends to crack in the recessed areas as it does not stretch like the fabric stretches. This will result in an unappealing design. If it is done after embossing, it must be done by hand which is time consuming and expensive.

Another disadvantage of embossing is that washing and garment care is more difficult because of the presence of backing material. The thickness of the embroidery makes washing and garment care more difficult.

There is considerable demand for new types of designs for T-shirts and sweatshirts. In particular, consumers would like to have a T-shirt or a sweatshirt with a multi-color design in low relief that has a soft hand on both the back and the front of the fabric. Consumers also want garments that hold up in repeated washing and retain a strong appeal.

3. Prior Art

U.S. Pat. No. 4,845,778, issued on Jul. 11, 1989 (Peterson) discloses a child's garment having a design made of a heat settable material which has been caused to rise slightly above the surface of the garment. This design is for the purpose of providing an anti-skid surface, especially in the knee area. The material providing the anti-skid surface is printed or painted upon the garment and upon curing expands to form a raised surface. This patent mentions a product sold under the tradename "Puffy Pen". This patent also discloses an alternate construction in which the pad is made from a fabric, plastic or other material which can be embossed or formed with a roughened surface to increase the friction as a child crawls. This patent does not disclose or suggest the use of an ink containing a puffing agent and using a molding die to form a design in relief.

U.S. Pat. No. 4,933,991, issued on Jun. 19, 1990 (Love) teaches a dress shirt having printed on the front a dyed portion in the shape of a tie. This portion is printed with a "puffed" ink to provide depth and bulk. The ink is applied artistically to create the design and allowed to dry. Heat is then applied by an iron or oven to cure the ink causing the design to rise up or puff. This patent does not disclose that a molding die may be used to produce a design in relief in the ink.

SUMMARY OF THE INVENTION

It is an object of this invention to produce a design in low relief which has a soft hand and can be manufactured in a simple, efficient and productive manner. Another object of this invention is to develop a method of producing an ink design in low relief on a fabric.

It is a further object of this invention to produce an ink designed in low relief on a fabric without the necessity of using any kind of backing material as is needed with embossing.

It is also an object of this invention to develop a method of producing designs in low relief on a fabric which can have sharp angles and corners as well as having gentle curves to give the designer more latitude in developing aesthetically appealing designs.

It is a further object of this invention to impart a soft hand to any screen-printed area surrounding the design in low relief.

These objects have been obtained by incorporating a puffing agent in a printing ink and applying it to the fabric in the area where the design is to be molded. This ink is preferably applied to the fabric by screen printing although other types of printing may be used, as well. The ink on the fabric is cured by putting the fabric in a conventional dryer which results in the ink expanding due to the presence of the puffing agent. After drying the design in relief is molded into the ink. A die is constructed for imparting the desired molded image in relief to the ink. The die is applied under heat and pressure to the area where the molded design in relief is to appear. With cotton and cotton blend fabrics, heat in the range of 360° to 375° F. is used at a pressure of between 45 to 60 p.s.i. A cotton blend fabric contains both cotton and plastics (e.g. polyester fibers). Normally, the die is held in the molding position for a period of between eight to sixteen seconds and then released. The precise time, pressure and temperature varies depending upon the type of fabric and ink employed and the design pattern. Heat and pressure complete the activation of the puffing agent resulting in the ink being molded into a low relief design. The die can be constructed of any suitable material (e.g. zinc alloy) and has a reverse image of the image molded in the ink.

A conventional embossing press can be used for holding the die in position and applying it to the ink on the fabric at the desired temperature, pressure and time. A transfer press can also be used to hold the mold and apply pressure and heat to the ink on the fabric.

A soft hand is obtained on the back of the fabric as the design in low relief is formed into the ink and not in the fabric to any substantial degree. In addition, the absence of any backing material as required in embossing and embroidery improves the feel of the back of the fabric. Embroidery designs are raised and do not have soft hand on the front of the fabric.

Because the area surrounding the design is frequently screen printed, a transfer paper can be placed on the fabric surrounding the design. The upper platen of the embossing or transfer press imparts heat and pressure to the transfer paper which in turn imparts a soft hand to that area of the fabric. The transfer paper prevents the fabric and ink from scorching or sticking to the upper platen. A transfer media other than transfer paper, such as an illustration board, may be used instead of transfer paper in this process.

If it is desired to have a tonal definition effect in the design, a base layer of ink (preferably a dark ink such as black) can first be placed on the fabric in the area where the design is to be imprinted. The ink with the puffing agent can then be placed over this base ink and a die used to imprint or mold the ink into a molded design. The color from the base layer will become visible in areas where the projections on the die penetrate to or into the first layer or base layer of ink. The process can be adapted so the tone of the first layer can appear in muted colors in other areas of the molded design to produce the desired color effect of the design. Both layers of ink are preferably applied by screen printing. The method of this invention is especially useful in producing designs in low relief on cotton or cotton blend shirts, hats and jackets, especially on T-shirts and sweatshirts. Because of the heat required in this molding process, it is most useful with cotton and cotton blend and denim fabrics and especially with dye washed cotton fabrics.

Simulated leather designs of striking appearance can be produced by first placing a black ink on the fabric and then applying an ink of a brown leather color containing a puffing agent. This produces a design that simulates leather.

The black ink appears through the design in muted form which is very similar to the appearance of leather. T-shirts and sweatshirts with designs in relief can be produced by this process by first screen printing in a conventional fashion the area of the shirt surrounding where the design in relief is to be placed. A dark base ink can then be applied to the area where the design in relief is to appear followed by an ink with a puffing agent and the molding process of this invention utilized. A soft hand can be imparted to both the front and back surfaces of the fabric where the design surrounding the design in relief is printed by using a flat platen with a transfer medium.

Because the ink contains a puffing agent, the design in relief is molded into the ink itself and not in the underlying fabric to any significant degree. The configuration of the underlying fabric is not changed in any significant way. This results in the back of the fabric having a soft hand which is especially important if the fabric is in a garment that is worn next to the skin. No backing fabric or paper is needed for molding this design in relief as is the case of conventional embossing or embroidery. The absence of any backing material required in embossing means that garment washing and care is much easier. Because the design is molded into the ink with the puffing agent, this process lends itself to molding in relief on all colors.

Conventional screen printing is usually preferred only on light colored garments because of the difficulty of placing enough ink on the fabric to cover a dark color. While screen printing can be used to print a dark colored fabric, the amount of ink required is objectionable because it does not result in a soft hand on the front of the fabric that is printed.

A design in relief made by this invention can be easily placed on a fabric regardless of its color because the design is molded into the ink and not the fabric. In fact, the fabric is not embossed and its configuration is only slightly changed. Conventional embossing results in stretching the material so that a soft hand is not achieved. The back side of the fabric produced by the process of this invention has a soft hand because the fabric has not been stretched to any significant degree. The design itself has a relatively soft hand because a small amount of ink is used and the puffing agent helps expand the ink so that it feels smoother than it otherwise would.

A design in relief can have sharp angles and corners as the design is molded into the ink. This cannot be done with conventional embossing because of the resistance of the fabric and backing. Being able to produce designs and reliefs that can have not only gentle curves and rounded shapes, but also sharp corners and angles greatly increases the types of designs that a designer can create. Having greater flexibility in the designs that can be produced greatly increases the ability of a designer to create aesthetic designs. Considerably more detail can be incorporated into a design in relief made by this invention than by embossing. Embossing molds with sharp corners and angles tend not only to meet the resistance of the material and backing through the projections in the designs, but these sharp projections tend to cut the fabric.

A transfer medium can be placed between the front of the fabric and the upper platen to prevent excessive heating of the fabric surrounding the design in relief. This produces a soft hand for this area of the fabric as well. The transfer medium permits a certain amount of heat with pressure from the upper platen to penetrate the fabric which results in driving any ink into the fabric rather than remaining on the surface.

A wide variety of molded designs in relief can be made using this invention. A virtually unlimited number of inks of different colors can be used as the base ink or as the ink containing the puffing agent to achieve the desired aesthetic effect.

DETAILED DESCRIPTION OF THE PREFERRED EMBODIMENTS

Figure 1:
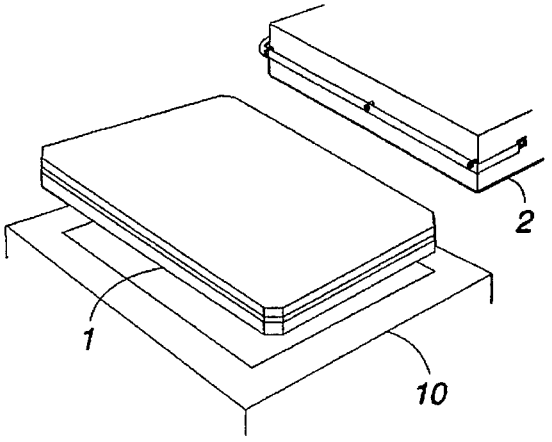
FIG. 1 is a partial top perspective view of the upper and lower platens of an embossing press in a disengaged position.

FIG. 1 is a top perspective view of the upper and lower platens of an embossing press in a disengaged position.

The numeral 10 illustrates the upper and lower platens of an embossing press which can be used to practice the method of this invention. The garment or fabric with a design die is placed in proper position on the lower platen 1. The upper platen 2 is then moved down so that it is directly above the lower platen 1 and in contact with the fabric. Pressure is then applied to the upper platen 2 which is heated until the design in relief is properly formed in the ink on the fabric. Other parts of the embossing press are not shown in this figure, but are of conventional construction.

Figure 2:
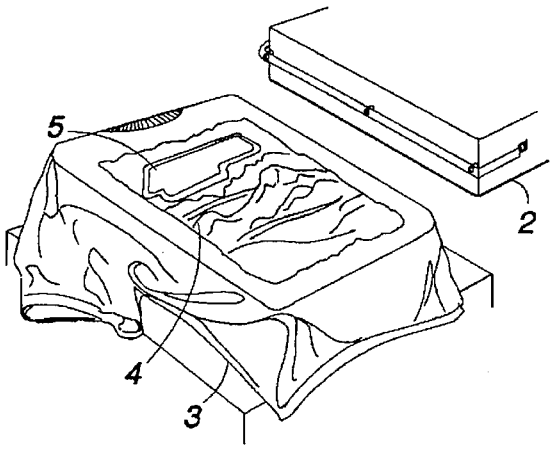
FIG. 2 is a partial top perspective view of an embossing press with the platens in a disengaged position with the garment placed on the lower platen in proper position for molding a design.

FIG. 2 is a top perspective view of the upper platen 2 and the lower platen 1 with a garment 3 placed in proper position on the lower platen 1 (not shown) for forming the relief design area 5.

While many different fabrics can be used to make the garment 3, it is preferred that cotton or cotton blends be used. Synthetic fibers, such as polyester, can be used. The type of ink and amount of heat and pressure can be adjusted if synthetic fibers are used. It is preferred that a substantial amount of natural fibers be used as most synthetic fibers are more subject to melting. A cotton blend of 30 to 90 percent cotton is preferred if synthetic fibers are to be used. A 50—50 percent cotton blend can have a design molded by the method of this invention very easily. Cotton and especially dye washed cotton fabrics are easily used for the production of designs in relief in accordance with the method of this invention. Although the method of this invention is primarily of importance in putting designs on garments, it can be used to place designs on other types of products. The design in relief can also be molded onto denim fabrics (e.g. denim jackets) as well.

The garment 3 can have a design in the surrounding area 4 which surrounds relief design area 5. The design in the surrounding area 4 can be made by any conventional process although screen printing is the most customary process. The relief design area 5 is first covered with an ink containing a puffing agent. A number of suitable inks containing puffing agents are available, or a commercially available puffing agent may be added to a conventional ink used in printing fabric. Water-based inks are preferred for environmental, health and safety reasons.

The relief design area 5 can be covered first with a base ink, which is also preferably water-based. The ink containing the puffing agent can then be applied to the relief design area 5. These inks are preferably applied by screen printing in sequence. The inks are then cured by drying. In some cases it may be necessary to cure the base ink first and then apply the ink with the puffing agent and then cure the latter ink. However, in most cases both inks can be cured simultaneously. This can be accomplished by running the printed fabric through a dryer. A dryer is typically set at temperatures between 700° and 800° F. with a belt speed of about 11 feet per minute. This drying also cures the top coat of ink containing the puffing agent. Curing at this stage is approximately 60% to 80% complete. Molding completes the curing of the ink containing the puffing agent.

A base ink may also be necessary if a tonal definition is desired in the molded design from an esthetic standpoint.

The method of this invention is especially useful for printing designs on T-shirts and sweatshirts made of cotton and cotton blends. It is especially useful on fabrics that are dye-washed.

Figure 3:
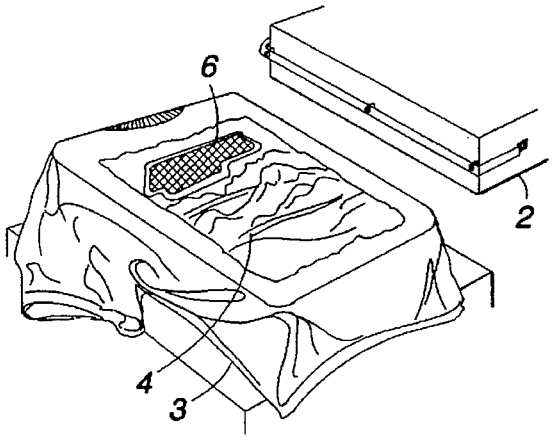
FIG. 3 is a partial top perspective view of an embossing press with the platens in a disengaged position with the soft mold die placed over the area of the garment in which a design in relief is to be formed.

After the ink or inks have been applied to the surrounding area 4 and relief design area 5, a molding die 6 is properly positioned in area 5 where the molded design is to be formed on the garment as shown in FIG. 3. The molding die is preferably constructed of a metal such as a zinc alloy in which the design in reverse is etched using an acid-resist technique. The molding die 6 has raised areas and recessed areas (not numbered) as best shown visually in FIG. 3 and 4. The molding die 6 produces a design in low relief in the ink with a puffing agent.

Figure 4:
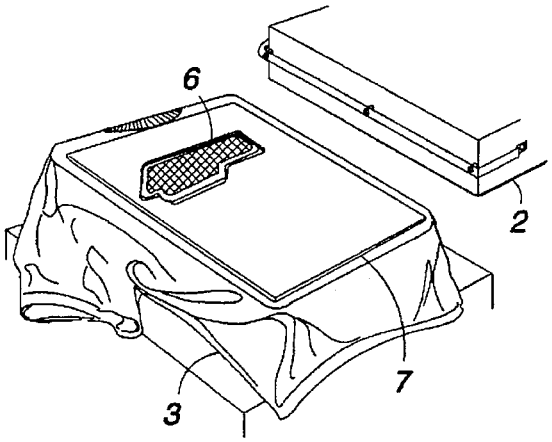
FIG. 4 is partial top perspective view of an embossing press with the platens in a disengaged position with the garment molding die and illustration board placed in proper position on the garment prior to forming the design in relief.

After the molding die 6 has been placed in proper position in relief design area 5, a transfer media 7 can be placed over the printing in surrounding area 4 as shown in FIG. 4. The transfer media can be a transfer paper or an illustration board. The transfer media allows pressure to be applied to surrounding area 4 of garment 3 and also permits the transfer of some heat to this area 4. This transfer media 7 prevents the fabric and ink in this area from scorching or sticking to the upper platen 2. Various types of transfer media 7 other than transfer paper can be used in this process. This transfer paper or illustration board is cut out around the molding die 6. If an illustration board is used, it can assist in holding the molding die 6 in proper position during the process.

Figure 5:
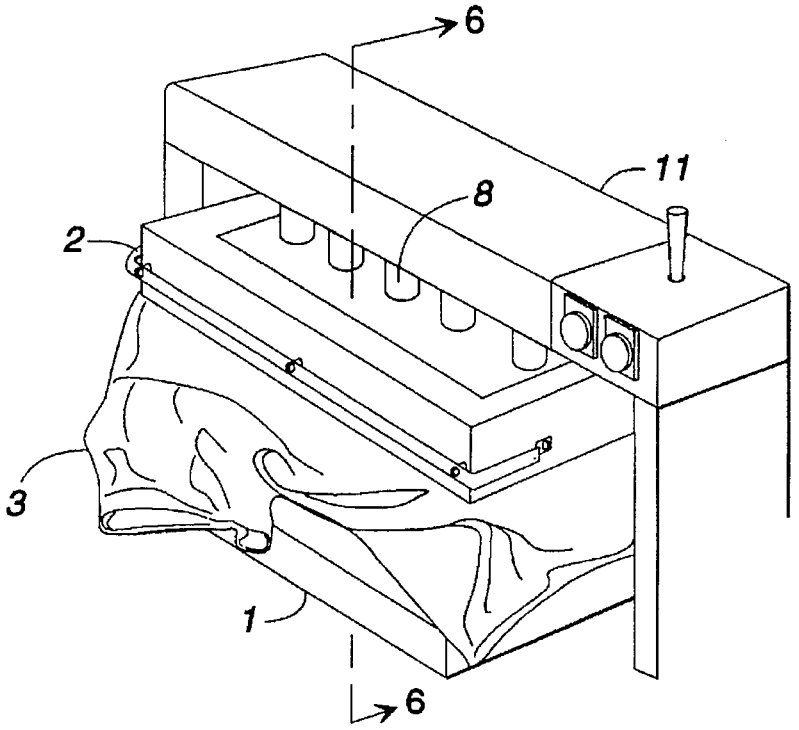
FIG. 5 is a partial top perspective view of an embossing press in which a garment, embossing die, and illustration board have been placed on the lower platen.

FIG. 5 is a partial top perspective view showing the garment 3 in proper position in the embossing press 11 prior to pressure being applied. The embossing press 11 has a series of hydraulic cylinders 8 with pistons for pushing the upper platen 2 down against the garment 3 and the lower platen 1 with the molding die 6 in proper place. The upper platen 2 can be heated by electrical coils (not shown) in the upper platen 2 or by other suitable means. The rest of the embossing press 11 is also of conventional construction.

Figure 6:
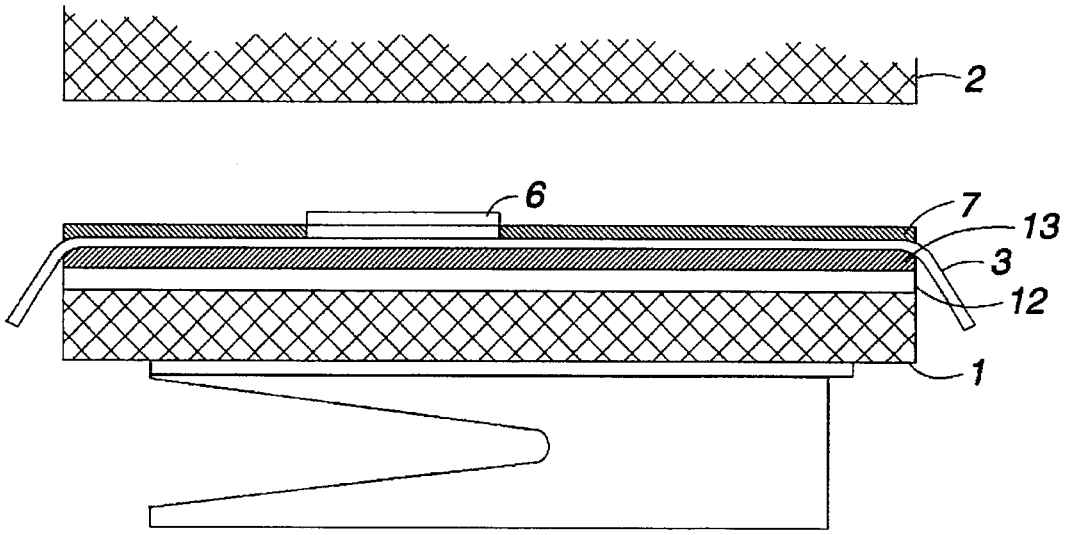
FIG. 6 is a cross-sectional view taken along line 6—6 in FIG. 5 showing the upper and lower platens with the garment in which the design in relief is to be formed in proper position just prior to pressing.

FIG. 6 is a cross-sectional view along line 6—6 of FIG. 5. FIG. 6 shows the various elements in position immediately prior to pressing. The lower platen 1 rests on base member 9. A foam rubber cushion 12 is usually placed over the lower platen 1, with a rubber pad 13 placed on top of cushion 12. The foam rubber cushion 12 provides flexibility which is necessary for receiving the recessed areas of the molding die 6 and to insure that even pressure is applied throughout the garment 3. The rubber pad 13 provides a semi-firm surface which is necessary for uniformity in forming the design in relief and enhancing the feel or hand of surrounding area 4.

As mentioned above, a transfer media 7 may be placed over the surrounding area 4. If the transfer media 7 is an illustration board, it helps hold the molding die 6 in place. In addition, it permits pressure to be applied to the surrounding area 4. The illustration board or transfer paper 7 permits a limited amount of heat to be transferred from the heating coils in the upper platen 2 to the garment 3. Without it, surrounding area 4 could be scorched or burnt. It is preferred that the heat and pressure be simultaneously applied to the surrounding area 4 with the molding process. However, it should be recognized that it can be done either before or after the molding process.

It should be recognized that it is not necessary to use an embossing press 11 as a simple transfer machine that can apply heat and pressure to the fabric or garment may be used in place of a more expensive embossing press.

The molding die 6 only produces the design in relief in the ink containing the puffing agent in relief design area 5. The design in relief is formed into the ink containing the puffing agent and not to any substantial degree in the fabric. This is because the puffing agent expands the ink which can then be compressed by the molding die 6. The physical configuration of the fabric is not substantially changed by this method.

In molding the design into fabrics the upper platen 2 should be heated to a temperature of between 360° and 375° F. at a pressure of from 45 to 60 p.s.i. applied to the upper platen 2 by hydraulic cylinders 8 which are hydraulically operated. The upper platen 2 is held in the pressed position between 8 to 16 seconds with most cotton and cotton blend fabrics. The time, pressure and heat will vary depending upon the fabric and inks that are used. Lower temperatures and different types of inks may be necessary in forming a design in relief into ink on fabrics that are synthetic or contain a high percentage of synthetic fibers.

The transfer media 7 permits heat from the upper platen 2 to penetrate into the fabric driving some of the ink into the fabric. This imparts a soft hand to the fabric in the surrounding area 4. Because some of the ink is driven into the fabric with some remaining on the surface, the hand of the fabric is made much softer.

The molded designs in relief produced by the method of this invention are in actual physical relief in the ink. Because the molding die 6 can have a number of levels of relief, a wide variety of designs can be made. This also permits the molded design to have the desired color effect. This is especially true when both a base ink and an ink with a puffing agent are used. The use of the ink with a puffing agent permits a wider variety of designs than if a design is simply embossed onto the fabric.

Because the ink containing the puffing agent is flexible, designs in relief that have sharp corners and angles containing much detail can be formed. These types of designs cannot be made by conventional embossing, as a dye necessary for such embossing would tend to cut the fabric and meet resistance from the fabric and especially the adhesive backing. The capability of this process to make designs with considerable detail, sharp angles and corners greatly expands the designers options.

The amount of time required to produce the design in relief is much less than with embossing because only the puffing ink is molded in relief. When a fabric is embossed, the embossing die must be held in place for a longer time because of the necessity of stretching the fabric and fixing it into proper position before releasing.

After molding the design, the fabric can undergo any additional processing that is desired. The method of the present invention is especially useful on cotton fabrics and in particular, T-shirts and sweatshirts. It can also be used to produce molded designs in relief on denim fabric such as denim jackets.

An important feature of the method of the present invention is that it can be used for the tonal definition of a molded designs in relief. For example, a black ink can first be printed as a base ink on the area in which the molded design is to appear. Then if, for example, a simulated leather design is desired, an ink of a brown leather color containing the puffing agent can be applied over the black ink. After the design in relief has been molded it has the appearance of leather. Muted black appears through the brown leather color which is especially striking on T-shirts and sweatshirts. The amount of black that is to appear is governed in part by the height of the projections in the molding die 6 along with the amount of heat and pressure.

The feel or hand of the fabric is especially soft when heat is applied to the surrounding area 4 to drive the ink into the fabric. Because the molding in relief is mostly in the ink containing the puffing agent and not significantly in the fabric, the back of the fabric beneath the molded design has a soft feel or hand. No significant permanent change is made in the configuration of the fabric. The front of the molded design in relief also has a soft feel or hand because the design is molded into the ink containing the puffing agent which is soft in texture.

METHOD OF OPERATION

In operation, a design in reverse is placed on a die, preferably made of zinc alloy, by etching or other techniques.

If a base ink is desired in the relief design area 5, it is placed in this area preferably by screen printing. If the base ink is not necessary or desired, then an ink containing a puffing agent may be placed directly in the relief design area 5. Preferably, these inks are placed in this relief design area 5 by screen printing. If a base ink is used, the ink containing a puffing agent would be placed in this area after the base ink has dried. The ink is preferably cured in a conventional fashion by running it through a dryer on a belt. This cures the ink containing the puffing agent to a stage that is approximately 60% to 80% complete. The remaining cure is accomplished during the molding operation which applies heat to the design in relief.

The surrounding area 4 may contain a design. Preferably, this design is placed on the fabric prior to placing ink in the relief design area 5. Screen printing is also used in connection with the design in surrounding area 4.

After this is done, the garment 3 is placed on the top of the lower platen 1 in proper position for forming the design in relief.

A die 6 is then placed in proper position in relief design area 5. An illustration board or transfer paper 7 can then be placed over the surrounding area 4 if desired. If the illustration board is of significant thickness, it will help hold the die 6 in proper position.

As illustrated in FIG. 5, pistons in hydraulic cylinders 8 can move the upper platen 2 down on the garment 3. Heat of the proper temperature is applied to the upper platen 2. Preferably, heating coils are run through the upper platen 2. After the pistons in the hydraulic cylinders 8 push the upper platen 2 into the proper position against the garment 3, it is held in contact from 8 to 16 seconds with cotton fabric. The temperature of the upper platen 2 is usually maintained between 360° and 375° F. at 45 to 60 p.s.i. The precise temperature, time and pressure will vary depending upon the fabric construction, the design of the die, and the type of fabric being used.

After the appropriate time has elapsed, the upper platen 2 is raised and the garment removed so that the next garment can be processed.

The above description sets forth the best mode of the invention as known to the inventor at this time, and the above examples are for illustrative purposes only, as it is obvious that one skilled in the art may make modifications to this process without departing from the spirit and scope of the invention and its equivalents as set forth in the appended claims.

The invention will be further illustrated in greater detail by the following specific Example. It should be understood, however, that although this Example may describe in particular detail some of the more specific features of the present invention, it is given for purposes of illustration and is not to be construed as limitative of the broader aspects of the invention.

EXAMPLE

Tal-Ink. manufactured by Tal Inc., Limited was screen printed onto an area of the front of a T-shirt where the design in relief was to be formed. The Tal-Ink was a carbon black ink with 1–3% accelerator added to speed up the drying time. This ink was to serve as a base for the design. The base Ink was flash cured on a M&R press at approximately 900° F. for about nine seconds. Tal-Ink 2000 series opacity waterbase ink was screen printed onto the base ink. This ink contains a puffing agent. The garment was then run through a dryer set at 750° F. with a length of 20 feet at a belt speed of eleven feet per minute. The dryer cured the ink containing the puffing agent to approximately 70–80% of completion.

A zinc alloy molding die with the design in reverse was etched using an acid-resist technique. The die was placed on the lower platen of a manually operated embossing press and the garment placed so that the area in which the design in relief was to be formed was centered above the molding die. A transfer media was placed over the area surrounding the area where the design in relief was to be formed as a design had been previously screen printed in the surrounding area.

The upper platen was heated to a temperature of 370° F. The upper platen of the embossing press was closed and held in position at a pressure of 60 p.s.i. for 10 seconds. Heat was applied by the upper platen and transferred through the transfer paper and into the garment The design in relief was formed with sharp corners and angles, and in sharp detail. This process produced a design in relief of considerable detail and which had a soft hand on the front and the back of the design and also on the area surrounding the design in relief on which the design had been screen printed.

What is claimed is:

1. A method of molding a design in low relief in an area of a printing ink placed on a surface of a fabric with a front and back surface which comprises:

a) placing a printing ink containing a puffing agent on the area on a surface of the fabric where the design is to be molded; and b) applying a molding die which has a reverse impression of the molded design to the area on a surface of the fabric where the ink was placed under sufficient heat and pressure for a time sufficient to complete the activation of the puffing agent and curing the ink so the design is molded in low relief in the ink without making a significant permanent change in the physical configuration of the fabric.

2. The method of claim 1 in which the ink is a water-based ink.

3. The method of claim 1 in which the fabric is constructed of fibers containing a substantial amount of natural fibers.

4. The method of claim 2 in which the fabric is cotton.

5. The method of claim 2 in which the fabric is a cotton blend.

6. The method of claim 4 in which the molding die is heated to between 360° and 375° F. at a pressure between 45 and 60 p.s.i. for 8 to 16 seconds sufficient to mold the design into the ink.

7. The method of claim 5 in which the molding die is heated to between 360° and 375° F. at a pressure between 45 and 60 p.s.i. for 8 to 16 seconds sufficient to mold the design into the ink.

8. The method of claim 1 in which a design has also been placed on at least part of the area surrounding where the design in relief is to be molded and a heat transfer medium has been placed on said area and then applying a platen of a press to said area with at least one of the platens being heated at a sufficient temperature, pressure and time to impart a soft feel or hand to said area of the fabric.

9. The method of claim 6 in which a design has also been placed on at least part of the area surrounding where the design in relief is to be molded and a heat transfer medium has been placed on said area and then applying a heated platen to said area at a sufficient temperature, pressure and time to impart a soft feel or hand to said area at the same time the molding die is applied to the area of the front surface of the fabric where the design is to be molded.

10. The method of claim 7 in which a design has also been placed on at least part of the area surrounding where the design in relief is to be molded and a heat transfer medium has been placed on said area and then applying a heated platen to said area at a sufficient temperature, pressure and time to impart a soft feel or hand to said area at the same time the molding die is applied to the area of the front surface of the fabric where the design is to be molded.

11. The method of claim 2 in which the fabric is a dye washed cotton.

12. The method of claim 11 in which the fabric has been made into a T-shirt prior to molding the design.

13. The method of claim 11 in which the fabric has been made into a sweatshirt prior to molding the design.

14. The method of claim 6 in which an ink of a different color than the ink containing the puffing agent is placed on the area on the front surface of the fabric where the design is to be molded prior to the placement of the ink containing the puffing agent so as to impart a tonal definition effect to the molded design.

15. The method of claim 8 in which an ink of a different color than the ink containing the puffing agent is placed on the area on the front surface of the fabric where the design is to be molded prior to the placement of the ink containing the puffing agent so as to impart a tonal definition effect to the molded design.

16. The method of claim 8 in which a press is used which has an upper and lower platen with the molding die being held in place on one of the platens and one of the platens being heated to impart heat to the molding die and to the area surrounding where the design in relief is to be molded to impart a soft feel or hand to said area of the fabric.

17. The method of claim 2 in which the fabric is a denim.

18. The method of claim 16 in which a black ink is first placed on the fabric and the ink with a puffing agent is a brown ink which imparts a leather tonal definition to simulate the appearance of leather in the molded design in relief.

19. The method of claim 16 in which the die is placed on the lower platen of the press and is held in proper place by a transfer medium.

* * * * *